US010252275B2

(12) United States Patent
Suderman

(10) Patent No.: US 10,252,275 B2
(45) Date of Patent: Apr. 9, 2019

(54) MAGNETIC SEPARATOR CONVEYOR

(71) Applicant: Bunting Magnetics Company, Newton, KS (US)

(72) Inventor: Donald A. Suderman, Newton, KS (US)

(73) Assignee: Bunting Magnetics Co., Newton, KS (US)

( * ) Notice: Subject to any disclaimer, the term of this patent is extended or adjusted under 35 U.S.C. 154(b) by 0 days.

(21) Appl. No.: 15/495,361

(22) Filed: Apr. 24, 2017

(65) Prior Publication Data

US 2017/0232449 A1 Aug. 17, 2017

(51) Int. Cl.
*B03C 1/18* (2006.01)
*B03C 1/30* (2006.01)
*B03C 1/033* (2006.01)

(52) U.S. Cl.
CPC ..... *B03C 1/18* (2013.01); *B03C 1/0332* (2013.01); *B03C 1/30* (2013.01); *B03C 2201/20* (2013.01)

(58) Field of Classification Search
CPC ..... B03C 1/0332; B03C 1/18; B03C 1/30
USPC ..... 209/12.1, 39, 215, 218, 219
See application file for complete search history.

(56) References Cited

U.S. PATENT DOCUMENTS 3,922,219 A * 11/1975 Lee ..... B03C 1/035 209/223.2
4,451,360 A * 5/1984 Salmi ..... B03C 1/10 209/215
4,867,866 A * 9/1989 Mayberry ..... B03B 9/06 209/30
5,148,921 A * 9/1992 White ..... A24B 1/04 209/20
6,250,474 B1 * 6/2001 Howell ..... B03C 1/247 209/213
8,158,902 B2 * 4/2012 Valerio ..... B07C 5/344 209/556
2006/0096894 A1 * 5/2006 Brandner ..... B03C 1/08 209/127.1
2007/0187299 A1 * 8/2007 Valerio ..... B03B 5/44 209/12.1
2013/0313167 A1 * 11/2013 Vandemierden ..... B03B 9/04 209/214
2014/0014560 A1 * 1/2014 Rhodes ..... B03C 1/02 209/217

(Continued)

*Primary Examiner* — Terrell H Matthews
(74) *Attorney, Agent, or Firm* — Kenneth H. Jack; Davis & Jack, L.L.C.

(57) ABSTRACT

A magnetic separator incorporating a rigid frame having left and right rails having longitudinal and oppositely longitudinal ends; longitudinal and oppositely longitudinal rollers respectively mounted at the left and right rails' longitudinal and oppositely longitudinal ends, the longitudinal roller having an interior cylindrical space; a multiplicity of magnets within the interior cylindrical space; a continuous loop belt mounted over the longitudinal and oppositely longitudinal rollers, the belt having a longitudinally movable upper flight, a longitudinal end, and a simultaneously oppositely longitudinally movable lower flight having a longitudinal end; a plenum mounted beneath the lower flight, the plenum having an air input port and having an air output port, the plenum's air output port being positioned for directing a flow of air toward the lower flight's longitudinal end; and an air impeller operatively mounted in communication with the plenum's air input port.

7 Claims, 6 Drawing Sheets

(56) References Cited

U.S. PATENT DOCUMENTS

2014/0102955 A1* 4/2014 Viny ..... B07B 4/04
209/644

* cited by examiner

MAGNETIC SEPARATOR CONVEYOR

FIELD OF THE INVENTION

This invention relates to magnetic separator conveyors. More particularly, this invention relates to such conveyors which incorporate at the conveyor's output end, a high intensity magnetic roller.

BACKGROUND OF THE INVENTION

Input materials which are commonly processed and separated by high intensity magnetic separating conveyors commonly comprise a random mixture or conglomeration of non-ferrous parts, pieces, and fragments, along with stainless steel items, parts, and pieces. The intermixed stainless steel items often include nickel within their metal alloys, in addition to chromium, for enhancement of the alloy's corrosion resistance. Such nickel additives within the stainless steel alloy substantially nullifies the metal's paramagnetic character and causes the metal to have a very low level of magnetic susceptibility. Though such nickel and chromium stainless steel alloys are dominantly ferrous, they are commonly described as non-magnetic.

In many circumstances, materials which are to be processed by a high magnetic strength separator conveyor are preliminarily passed through a conventional low magnetic intensity separation process in order to initially remove the material's paramagnetic or magnetically susceptible ferrous parts, fragments, and pieces. As a result of performance of such preliminary low intensity magnetic separator, the less magnetically susceptible stainless steel parts and fragments within the mixture are made amenable to separate separation via higher strength magnets. A high intensity magnetic separating conveyors are known to be utilized in the performance of such subsequent separating step.

The effectiveness of such high intensity magnetic separating conveyors in performing such second phase separation of the stainless steel parts and pieces is commonly degraded by the continued presence within the parts mixture of non-magnetic plastic debris and fibrous material which is impregnated or coated with ferrous dust and filings or microscopic bits of tramp iron. Such ferrous dust coated non-ferrous debris particles often remain within the parts mixture following the initial low magnetic intensity magnetic separation step, and such debris remains susceptible to unwanted subsequent extraction and separation along with the stainless steel parts during the subsequent conveyor actuated high intensity magnetic separation step. Concurrent final phase separations of the stainless steel and the ferrous dust coated non-ferrous debris undesirably fouls and contaminates the stainless steel output of the conveyor based high magnetic intensity separation step.

The instant inventive magnetic separating conveyor solves or ameliorates such stainless steel output contamination problem by mechanically integrating within the separator conveyor a reverse air flow generating apparatus which is capable of forwardly winnowing the ferrous dust coated non-ferrous debris at the point of magnetic release of the stainless steel parts and pieces.

BRIEF SUMMARY OF THE INVENTION

A first structural component of the instant inventive magnetic separating conveyor comprises a rigid frame which incorporates left and right rails or side walls which extend along the longitudinal length of the conveyor. In a suitable embodiment, the rigid frame is substantially configured as a ladder frame structure or chassis.

Further structural components of the instant inventive magnetic separator comprise longitudinal and oppositely longitudinal rollers which function as pulleys for guiding and driving a thin and preferably magnetically transparent continuous loop belt. The invention's longitudinal and oppositely longitudinal rollers are preferably rotatably mounted respectively to the longitudinal and oppositely longitudinal ends of the rigid frame. In a preferred embodiment, the longitudinal end of the conveyor is its output end, and the longitudinal roller mounted at that end constitutes an idler or free turning roller. The invention's oppositely longitudinal roller at the conveyor's input end preferably constitutes an axle driven roller to which a rotary output of an electric motor is preferably operatively connected.

In the preferred embodiment, the invention's longitudinal roller defines a hollow interior cylindrical space within which a multiplicity of magnets are fixedly mounted. In a preferred embodiment, the longitudinal rollers' interior mounted magnets are permanent magnets which are configured in accordance with the high intensity magnetic roller disclosed in US Patent Application Publication No. 2016/0310962; published Oct. 27, 2016; inventor, Donald A. Suderman. Such configuration of the magnets within the invention's longitudinal roller advantageously causes high intensity magnetic flux to emanate outwardly from the roller, and through the longitudinal end of the continuous belt loop.

A further structural component of the instant inventive magnetic separator comprises an air plenum which is preferably fixedly mounted between the rails of the conveyor's rigid frame, and is positioned beneath the belt's lower flight. In a preferred embodiment, the invention's plenum component is configured as a laminar air flow generating air knife. Suitably, the plenum component may alternatively comprise a box configured air conduit mounted beneath the conveyor's lower flight, or may comprise a conduit which functionally incorporates the conveyor's lower flight and side walls or rails.

In the preferred embodiment, the plenum component has an air output port positioned and oriented to direct a laminar or coordinated sheet configured stream of air in the longitudinal direction at or immediately below the continuously oppositely longitudinally moving juncture of the lower end of the longitudinal roller and the longitudinal end of the belt's lower flight. Ferrous dust coated non-ferrous debris which is securely magnetically attached to the belt's moving outer surface as the belt passes in a semi-circular arc over the longitudinal roller's longitudinal aspect, and such debris is effectively released from the magnetic attachment as the lower belt flight cycles tangentially away from such juncture.

The longitudinally traveling air stream is preferably provided by compressor or blower impelled air which is channeled into and through the plenum. Longitudinal emissions of such air advantageously winnow the iron dust bearing non-ferrous debris, causing such debris to separate from the heavier stainless steel items which normally fall oppositely longitudinally into a collection bin. Instead of constituting contaminating debris which is co-separated with the stainless steel output, the winnowing function which the inventive conveyor performs causes such non-ferrous debris to harmlessly fall forwardly into a separate bin along with other separated non-ferrous parts and pieces. Accordingly, the instant invention prevents undesirable contamination of the stainless steel output with the iron particle coated non-ferrous debris.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
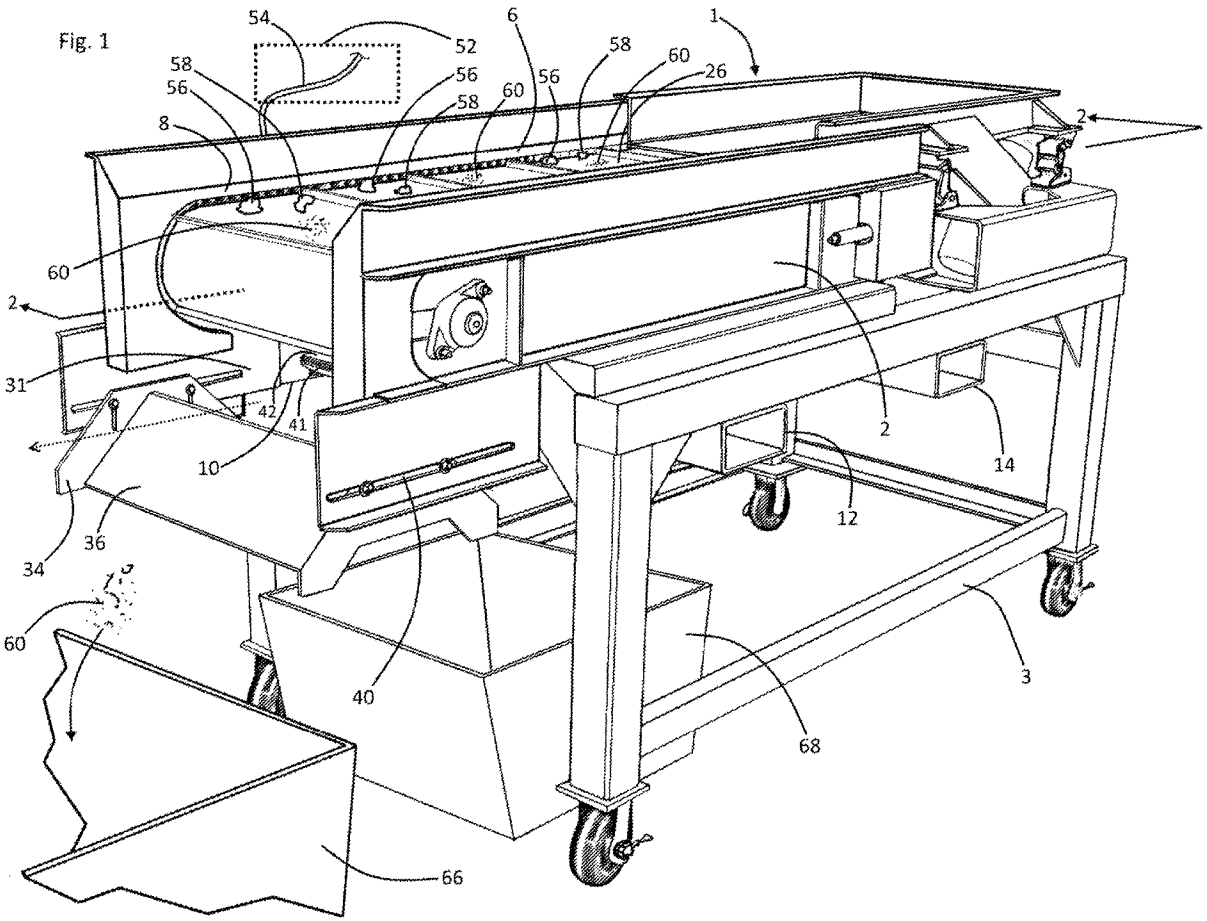
FIG. 1 is a perspective view of a preferred embodiment of the instant inventive magnetic separator conveyor.
Figure 2:
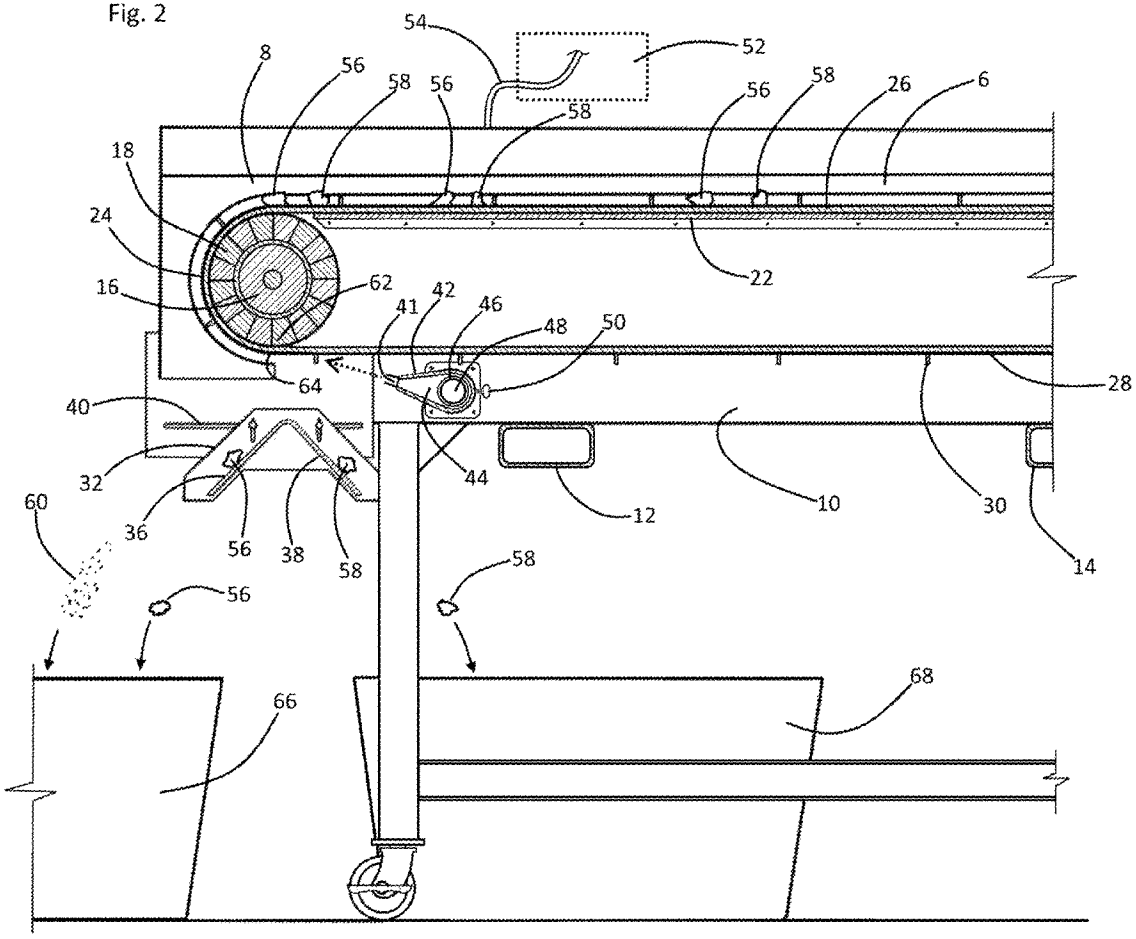
FIG. 2 is a sectional view, as indicated in FIG. 1.

Referring now to the drawings, and in particular to Drawing FIGS. 1 and 2, a preferred embodiment of the instant inventive magnetic separator conveyor is referred to generally by Reference Arrow 1. The magnetic separator 1 has left and right frame rails 2 and 6, such rails having longitudinal ends 4 and 8, and having oppositely longitudinal ends opposite from ends 4 and 8. In a preferred embodiment, the conveyor's side wall support rails 2 and 6 are rigidly supported by a rolling chassis frame 3 which incorporates laterally extending support rungs or crossbeams 12 and 14 which provide undergirding support to the rails 2 and 6.

A longitudinal roller or pulley 16 spans laterally between the longitudinal ends 4 and 8 of the rail components 2 and 6, the axial ends of such roller 16 being supported by rotary bearings 20. In the preferred embodiment, the longitudinal roller 16 constitutes an idler or free turning roller, while the invention's oppositely longitudinal roller (which is similarly rotatably mounted at the oppositely longitudinal ends of rails 2 and 6) constitutes a motor driven roller.

A continuous loop belt 24 having upper and lower flights 26 and 28 is mounted over a slide floor 22 and about the longitudinal and oppositely longitudinal rollers in the manner depicted in FIG. 2. To assist in the upper flight's longitudinal carriage of parts, pieces, and debris to be magnetically separated, laterally extending cleats or vanes 30 are fixedly attached to the outer surface of the belt 24.

A cylindrical annulus of permanent magnets 18 is preferably fixedly mounted within the interior space of the longitudinal roller 16. In the preferred embodiment, and for purposes of enhancement of magnetic strength, the permanent magnets 18 are preferably configured arranged in the manner described in US Patent Application Publication No. 2016/0310962 published Oct. 27, 2016; inventor, Donald A. Suderman.

The instant inventive magnetic separator conveyor further comprises an air plenum which is fixedly mounted and operatively positioned beneath the lower flight 28 of the continuous loop belt 24. In a preferred embodiment, the plenum component comprises an laminar air flow producing air knife 42 which is laterally opened by an air inlet port 48 and is longitudinally opened by laterally oblongated air outlet port 41. In the preferred embodiment, the laterally oblongated air outlet port 41 is co-extensive with the lateral width of the continuous loop belt 24. An air tube or conduit 54 communicates with the plenum's air inlet port 48, and such conduit 54 is preferably supplied with air by a source of compressed or driven air, such as a fan, an air blower, or an air compressor. Such air impelling components are represented in FIGS. 1 and 2 by dashed line box 52. The air knife configured plenum 42 may be mounted upon the downward extensions 10 of the conveyor's rails 2 and 6, and such connection may include an angular repositioning facilitating rotary bearing 46. Upon angular adjustment of the output port 41 of the air knife 42 to point toward the lower end 62 of the roller 16, and toward the longitudinal end 64 of the belt's lower flight 28, air emitting from the interior 44 of the plenum/air knife 42 may travel in the direction of the dashed line arrow drawing FIG. 2. Such air flow advantageously effects debris winnowing in manners discussed below.

In operation of the instant inventive magnetic separator conveyor, and assuming that the air impeller 52 comprises an air compressor, such compressor may be actuated to drive compressed air through conduit 54 to emit from port 48 into the interior 44 of the air knife configured plenum 42. Such air next emits longitudinally from port 41 to flow toward and to impinge against portions of the longitudinal end 64 of the continuous loop belt's lower flight 28 which immediately underlie the lower end 62 of the roller 16. Upon cycling rotation of the continuous loop belt over the floor 22 and over the longitudinal and oppositely longitudinal rollers, the air emitting from the air knife 42 continually washes over such lower roller end, such air emitting in the direction of the dashed line arrow drawn upon FIG. 1 through an air gap space 31 which is formed between a "V" plate separator 32 and the roller 16.

The upper flight 26 of the continuous loop belt 24 continuously travels longitudinally and slidably over conveyor belt floor 22, and during active material separating use such flight 26 commonly carries a mixed assemblage of non-ferrous parts and fragments 56, stainless steel parts and fragments 58, and smaller fragments of non-ferrous scrap and debris 60 which is commonly coated or impregnated with ferrous or iron containing dust. As the larger non-ferrous parts and pieces 56 approach the longitudinal end of the upper flight 26, such parts experience little or no magnetic attraction at and around the magnetic roller 16, and such pieces fall longitudinally and downwardly against a sloped longitudinal face 36 of "V" separator 32, and thence further fall downwardly into a forward collection bin 66. In contrast, stainless steel parts and pieces 58 which are carried along the upper flight 26, travel semi-circularly about roller 16 as a result of the roller's intense magnetic field. Such stainless steel parts and pieces are released at the lower end 62 of the roller 24 to fall downwardly and oppositely longitudinally against the sloped oppositely longitudinal face 38 of the "V" separator 32, and further fall into a longitudinally rearward separation bin 68. The longitudinal position of the "V" separator may be positioned along adjustment slots 40 to assure that such separator accurately discriminates between the falling paths of the non-ferrous parts 56 and the stainless steel parts 58.

Iron dust impregnated or coated non-ferrous debris 60 is, similarly with the stainless steel parts and pieces 58, magnetically attracted and released at the lower end 62 of the roller 16. However, as a result of the longitudinal emission of air from the plenum/air knife 42, such falling debris is advantageously forwardly or longitudinally winnowed to fall forwardly and downwardly against separation face 36, and to further fall downwardly into the longitudinal bin 66. Accordingly, the instant invention's incorporation of the air knife configured plenum 42 advantageously prevents such debris 60 from being deposited into the oppositely longitudinal collection bin 36. Thus, the instant invention prevents the separated stainless steel within bin 68 from becoming fouled or contaminated with the non-ferrous debris 60.

Figure 3:
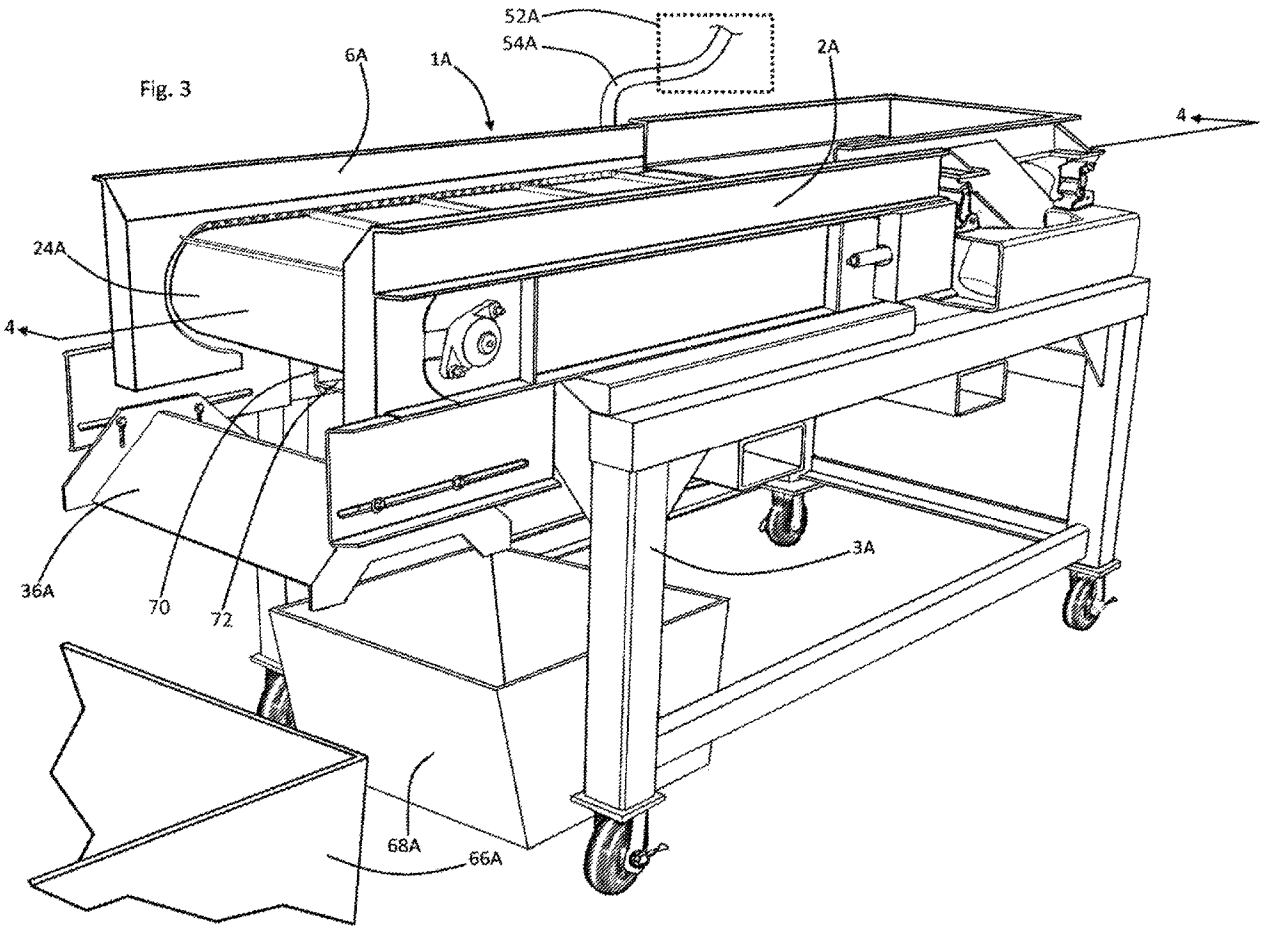
FIG. 3 presents an alternate configuration of the structure depicted in FIG. 1.
Figure 4:
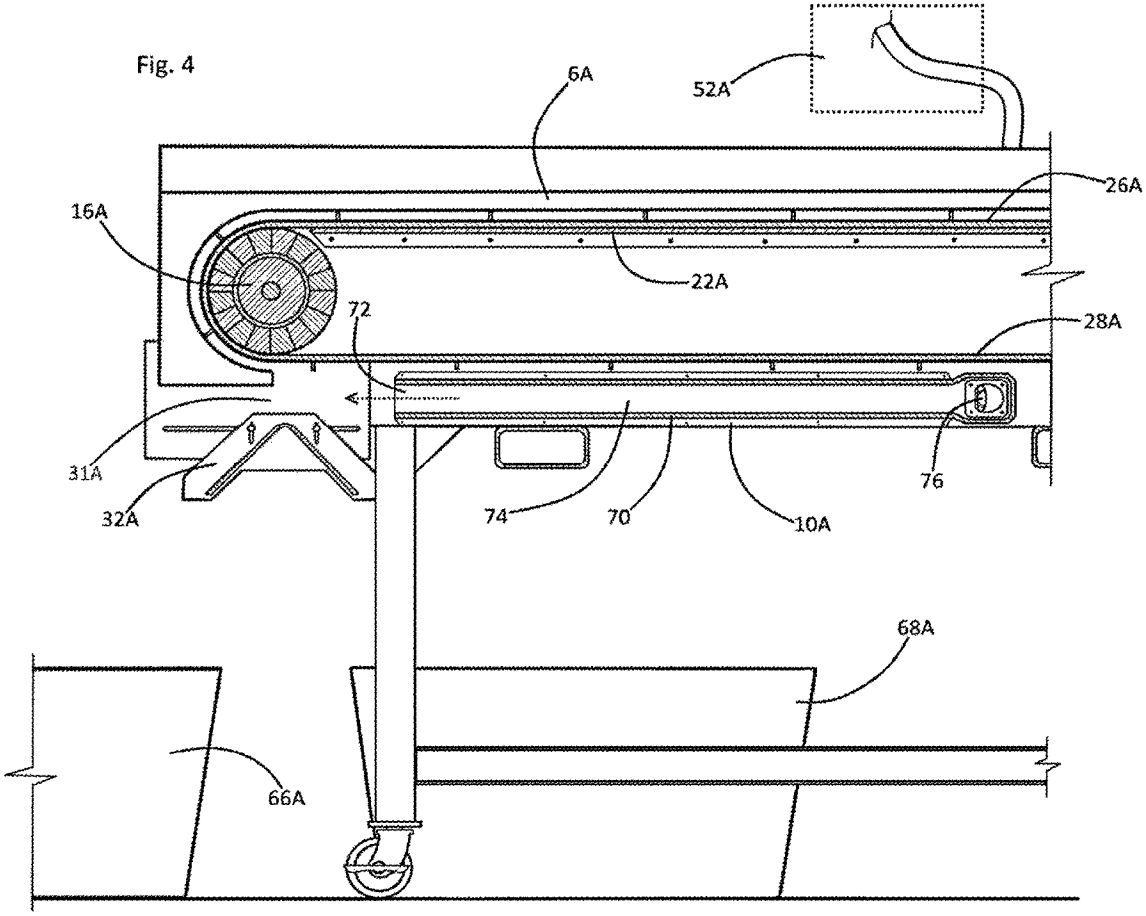
FIG. 4 is a sectional view, as indicated in FIG. 3.

Referring simultaneously to FIGS. 3 and 4, all reference numerals having a suffix "A" are configured substantially identically with similarly numbered structures drawn in FIGS. 1 and 2. In the FIGS. 3 and 4 structural alternative, the invention's air plenum component comprises a box conduit 70 having an air inlet port 76 at its oppositely longitudinal end, and having an air outlet port 72 at its longitudinal end. Such outlet port 72 is preferably laterally oblongated to co-extend with the width of the belt 24. Air traveling longitudinally within the interior 74 of such box conduit configured plenum 70 emits longitudinally through space 31A for forwardly or longitudinally winnowing iron dust bearing non-ferrous debris 60, and for causing such debris to harmlessly fall within longitudinal bin 66A.

Figure 5:
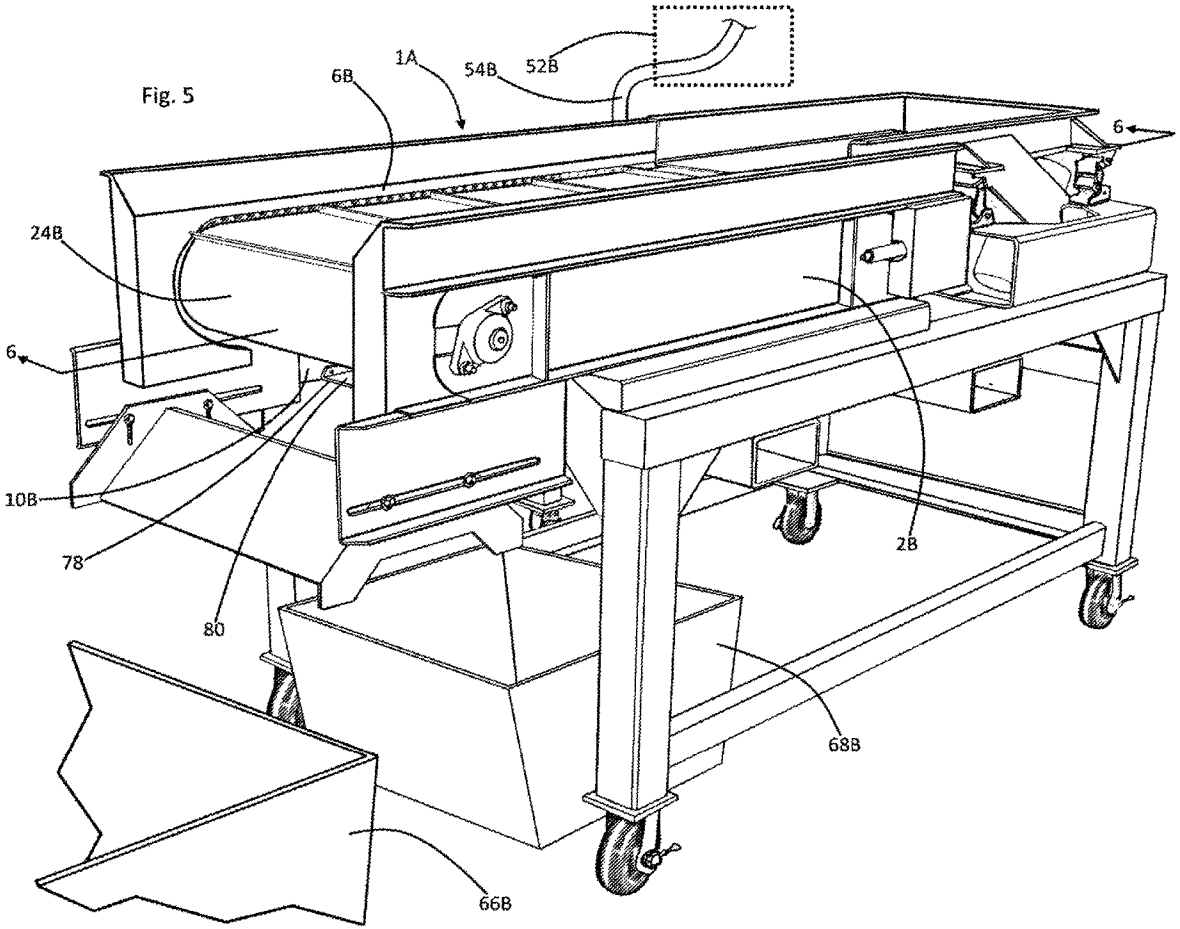
FIG. 5 is a further alternative configuration of the structure depicted in FIG. 1.
Figure 6:
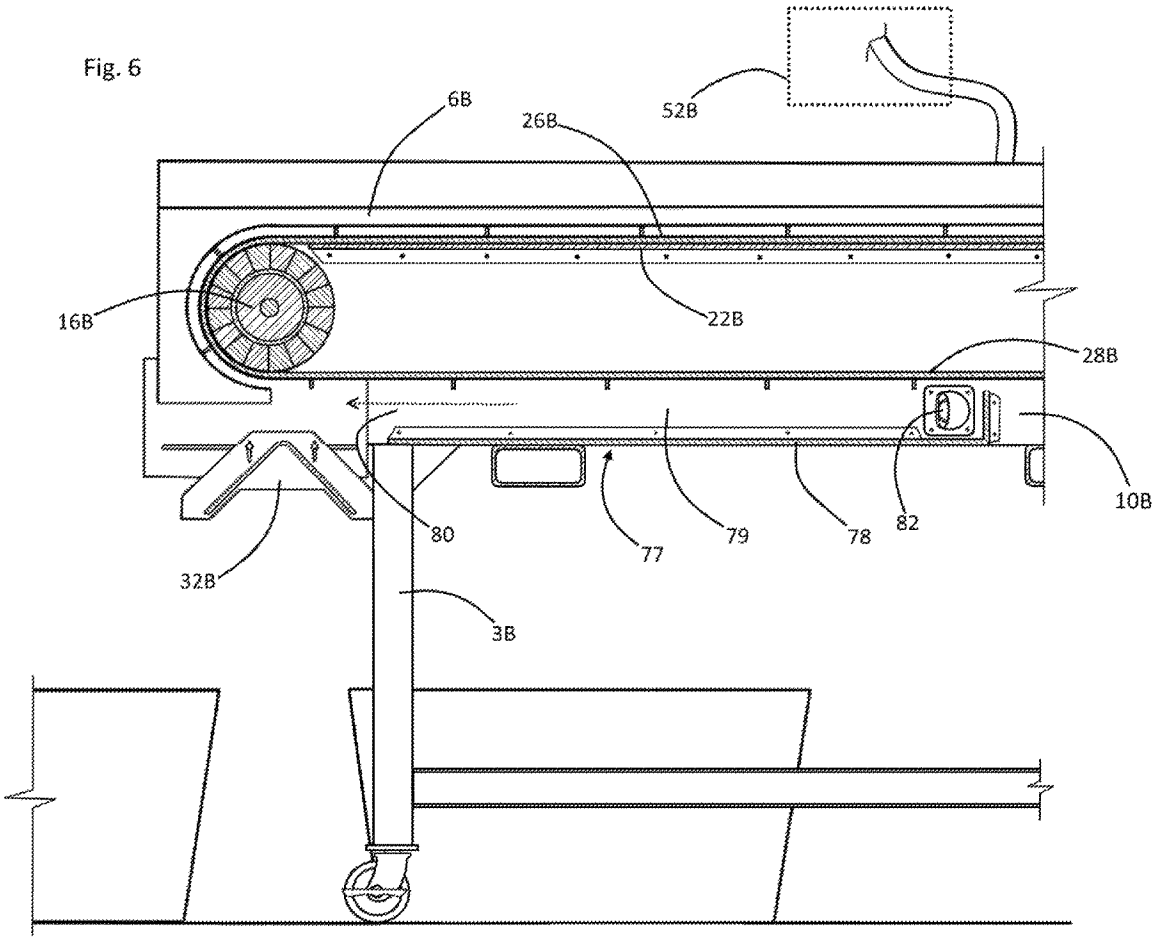
FIG. 6 is a sectional view, as indicated in FIG. 5.

Referring simultaneously to FIGS. 1, 2, 5, and 6, all structures of FIGS. 5 and 6 which are identified by a reference numeral having the suffix "B" are configured substantially identically with similarly numbered structures appearing in Drawing FIGS. 1 and 2. In the FIGS. 5 and 6 structural alternative, the invention's air plenum component is referred to generally by Reference Arrow 77. Such alternative plenum 77 incorporates the downward extensions 10B of the left and right rails 2B and 6B to serve as left and right plenum side walls. Such plenum 77 further incorporates a rigidly mounted floor panel 78 which spans between the lower ends of such rails/walls, and incorporates the lower flight 28B of the continuous loop belt 24B to functionally serves as the plenum's ceiling. The floor 78 and rail lower extension 10B, in combination with lower belt flight 28B effectively form a forward or longitudinal air outlet port 80. Air injected through air inlet port 82 travels through the interior 79 of such plenum 77 to emit forwardly for winnowing of non-ferrous iron dust laced non-ferrous debris 60 in the manner described above.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A magnetic separator comprising:

(a) a rigid frame comprising left and right rails having longitudinal and oppositely longitudinal ends;

(b) longitudinal and oppositely longitudinal rollers respectively mounted at the left and right rails' longitudinal and oppositely longitudinal ends, the longitudinal roller having an interior cylindrical space;

(c) a multiplicity of magnets mounted within the interior cylindrical space;

(d) a continuous loop belt mounted over the longitudinal and oppositely longitudinal rollers, said belt having a longitudinally movable upper flight having an upper surface and having a longitudinal end, said belt further having a simultaneously oppositely longitudinally movable lower flight having a lower surface and a longitudinal end;

(e) a plenum mounted upon the rigid frame, the plenum being positioned downwardly from the oppositely longitudinally moveable lower flight's lower surface, the plenum having an air input port and an air output port, the air output port being positioned for directing a flow of air toward said lower flight's longitudinal end; and (f) an air impeller operatively mounted in communication with the plenum's air input port, wherein the oppositely longitudinally movable lower flight is positioned below the longitudinally movable upper flight, and wherein the plenum is further positioned below both of said flights.

2. The magnetic separator of claim 1 wherein the plenum comprises an air knife having a laterally oblongated air outlet port.

3. The magnetic separator of claim 2 wherein the continuous loop belt has a width, and wherein the lateral oblongation of the air knife's air outlet is coextensive with said width.

4. The magnetic separator of claim 3 wherein the longitudinal roller has a lower end overlying the lower flight's longitudinal end, and wherein the air knife is positioned for upwardly angling its air outlet port toward said lower end and toward said underlying longitudinal end.

5. The magnetic separator of claim 1 wherein the plenum comprises a box conduit having a laterally oblongated port.

6. The magnetic separator of claim 5 wherein the box conduit is rigidly mounted between the left and right rails.

7. The magnetic separator of claim 5 wherein the left and right rails have downward extensions having lower ends, and wherein the box conduit comprises a combination of said downward extension and a floor spanning laterally between said downward extensions' lower ends.

* * * * *